US005165185A

United States Patent [19]

Gardaz et al.

[11] Patent Number: 5,165,185

[45] Date of Patent: Nov. 24, 1992

[54] IRONING DEVICE SOLE-PLATE WITH RESIN PROJECTIONS

[75] Inventors: Claudine Gardaz, Rumilly; Jean-Pierre Buffard, Tresserve, both of France

[73] Assignee: Seb S.A., Selongey, France

[21] Appl. No.: 699,924

[22] Filed: May 14, 1991

[30] Foreign Application Priority Data

May 18, 1990 [FR] France ..... 90 06258

[51] Int. Cl.[5] ..... D06F 75/38

[52] U.S. Cl. ..... 38/93

[58] Field of Search ..... 38/16, 74, 77.5, 77.3, 38/88, 93, 97

[56] References Cited

U.S. PATENT DOCUMENTS

| | | | |
|---|---|---|---|
| 2,270,316 | 1/1942 | Kuhn et al. | 38/93 |
| 3,238,650 | 3/1966 | Mullen | 38/93 |
| 3,480,461 | 11/1969 | Lynge | 38/93 X |
| 4,089,128 | 5/1978 | Baumgartner et al. | 38/93 |
| 4,800,661 | 1/1989 | Yamamoto et al. | 38/93 |
| 4,822,686 | 4/1989 | Louison et al. | 38/93 X |
| 5,025,578 | 6/1991 | Firatli et al. | 38/93 |

FOREIGN PATENT DOCUMENTS

| | | | |
|---|---|---|---|
| 0206121 | 12/1986 | European Pat. Off. . | |
| 0378479 | 7/1990 | European Pat. Off. . | |
| 2576253 | 7/1988 | France . | |
| 2641553 | 7/1990 | France . | |
| 0150799 | 8/1985 | Japan | 38/93 |
| 2270200 | 11/1987 | Japan | 38/93 |
| 63-71300 | 3/1988 | Japan | 38/93 |

*Primary Examiner*—Werner H. Schroeder
*Assistant Examiner*—Ismael Izaguirre
*Attorney, Agent, or Firm*—Young & Thompson

[57] ABSTRACT

The smoothing or pressing or steam iron has a metallic sole-plate (1) provided with an anti-adhesive coating (2). The sole-plate surface over the anti-adhesive coating has a series of projections (3) formed by an anti-adhesive coating based on fluorocarbon resin, with the result that the iron glides easily over textile fabrics.

5 Claims, 1 Drawing Sheet

FIG_1
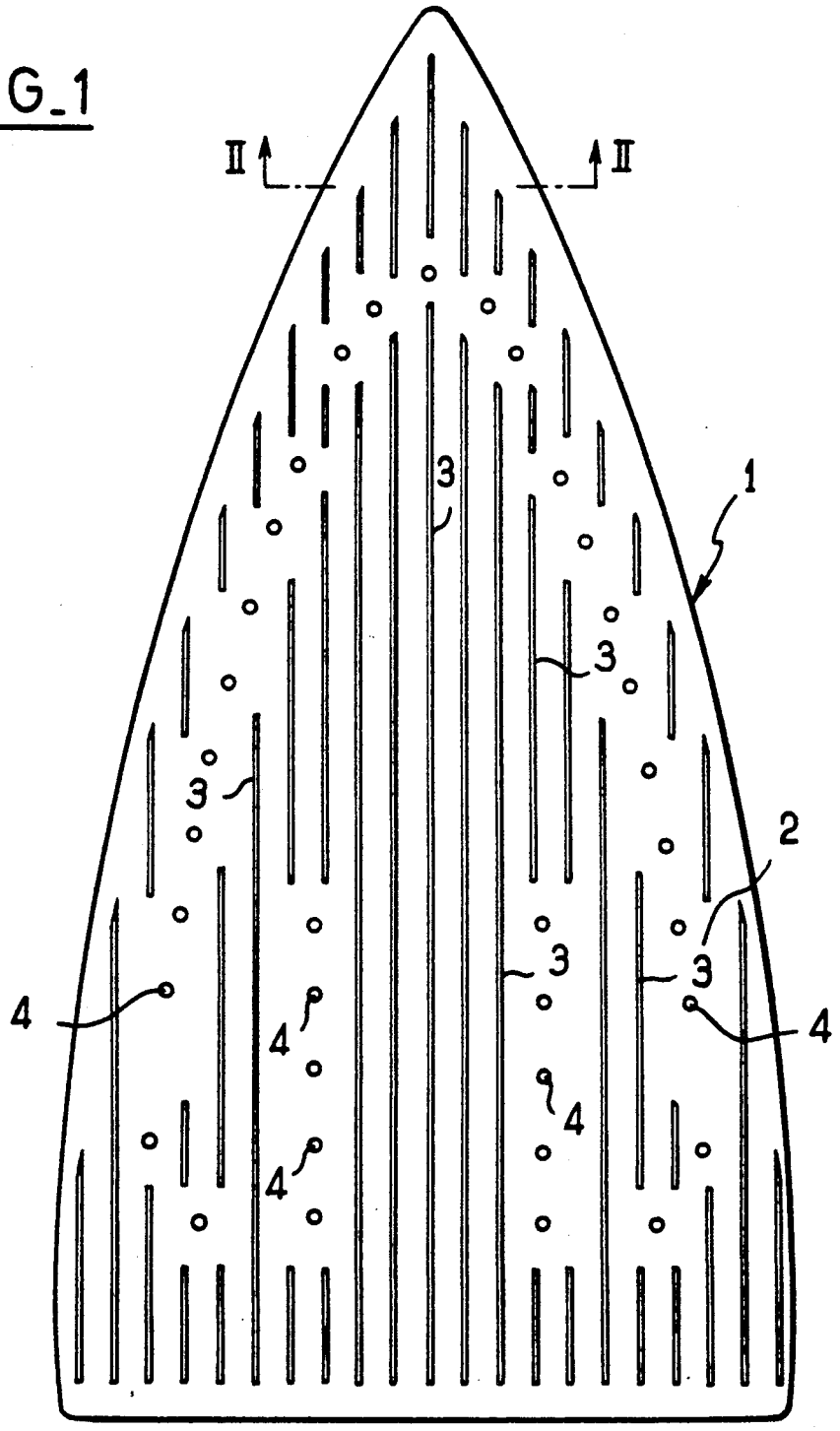
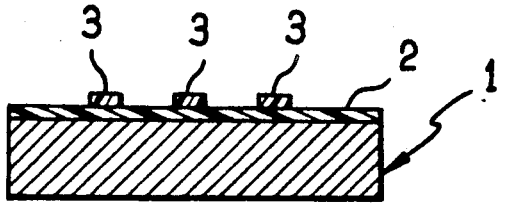
FIG_2

IRONING DEVICE SOLE-PLATE WITH RESIN PROJECTIONS

BACKGROUND OF THE INVENTION

1. Field of the Invention

The present invention relates to a laundry iron having a metallic sole-plate provided with an anti-adhesive coating.

2.Description of the Related Art

Sole-plates of laundry irons are usually of aluminum. The sole-plate face which is intended to come into contact with the articles to be ironed is polished in order to reduce the coefficient of friction with the articles to be ironed and thus to facilitate the ironing operation.

However, this polished surface is sensitive to stains which are difficult to clean and distinctly increase the coefficient of friction.

In order to overcome this disadvantage, the present Applicant has proposed to cover the surface of laundry-iron sole-plates with an enamel coating. This coating makes it easier to clean the surface of the sole-plate and improves the coefficient of friction, that is to say the "glide" of the iron.

However, enamel coatings are relatively sensitive to mechanical impacts. Chips formed in the enamel in the event of impact affect the coefficient of friction and consequently the glide of the iron.

Consideration has already been given to the possibility of coating the sole-plates of irons with a layer of anti-adhesive material based on fluorocarbon resin such as polytetrafluoroethylene.

However, a coating of this type has poor resistance to abrasion and the friction of the sole-plate on the articles to be ironed, in particular on hard portions such as buttons, zippers and the like causes rapid wear of the coating.

SUMMARY OF THE INVENTION

The object of the present invention is to overcome the disadvantages of the known designs by so shaping the surface of laundry-iron sole-plates that this surface not only has a distinctly lower coefficient of friction with the articles to be ironed but also has distinctly higher abrasion resistance.

In accordance with the invention, the laundry iron includes a metallic sole-plate distinguished by the fact that the sole-plate surface which is intended to come into contact with the articles to be ironed has a series of projections formed by an anti-adhesive coating based on fluorocarbon resin.

These projections formed of fluorocarbon resin reduce the contact surface between the sole-plate and the surface of the articles to be ironed, with the result that the "glide" of the sole-plate is distinctly improved with respect to a continuous, flat and smooth coating.

Moreover, the abrasion resistance is also improved.

This result can be explained by the fact that the hard and fine particles which are liable to penetrate between the sole-plate surface and the textile fabric to be ironed tend to slide within the spaces located between these projections, with the result that the fluorocarbon resin which forms a coating on the projections is less exposed to the effects of abrasion.

Thus the enhanced glide obtained in accordance with the invention is maintained over a long period of use of the iron.

In accordance with one embodiment of the invention, the aforementioned projections are made up of strips formed of anti-adhesive material based on fluorocarbon resin and applied on a coating based on fluorocarbon resin which covers the entire surface of the sole-plate.

In a preferred mode of execution of the invention, the strips having a fluorocarbon resin base are applied on the coating by screen process deposition. The fluorocarbon resin strips which can be formed by means of this technique have very sharply defined longitudinal edges and adhere perfectly to the subjacent coating.

Further distinctive features and advantages of the invention will become apparent from the description given below.

BRIEF DESCRIPTION OF THE DRAWINGS

FIG. 1 is a plan view of a laundry-iron sole-plate in accordance with the invention.

FIG. 2 is a sectional view taken along the plane II—II.

DETAILED DESCRIPTION OF THE PREFERRED EMBODIMENTS

In the embodiment of FIGS. 1 and 2, the sole-plate 1 of a steam iron is provided with a coating 2 based on fluorocarbon resin such as polytetrafluoroethylene, said coating being formed on the surface of the sole-plate which is intended to come into contact with the articles to be ironed.

The coating 2 is in turn covered with spaced strips 3 which are parallel and oriented in the longitudinal direction of the sole-plate. These strips 3 also have a base of fluorocarbon resin such as polytetrafluoroethylene.

The strips 3 can have a width within the range of a few tenths of a millimeter to a few millimeters and their thickness can vary between 2 and 50 μm, the preferred thickness being in the vicinity of 10 μm.

The strips 3 cover practically the entire surface of the sole-plate but are interrupted in the zones corresponding to the steam outlets 4.

The spacing between these strips 3 can vary between 1 mm and 1 cm approximately. These strips 3 are preferably applied on the coating 2 by screen process deposition in accordance with the method described in French patent No. 2,576,253 granted to the present Applicant.

The raised strips 3 deposited on the sole-plate coating by screen process have the effect of improving the glide of the sole-plate as shown in the following table.

| | Measured friction force | | |
|---|---|---|---|
| Nature of textile fabric | Sole-plate of bare aluminum | Sole-plate of aluminum coated with PTFE | Sole-plate of aluminum coated with PTFE + PTFE strips |
| Polyester | 350 g | 250 g | 200 g |
| Twill-weave cotton fabric | 360 g | 260 g | 210 g |

This table shows that, in the case of the sole-plate in accordance with the invention, the measured friction force is distinctly lower than in the case of a sole-plate which is simply coated with PTFE or of a sole-plate of bare aluminum The results thus show that the sole-plate in accordance with the invention glides with distinctly greater ease and therefore facilitates ironing.

Moreover, the "improved glide" sole-plate affords higher abrasion resistance.

In addition, the raised strips constitute wearing strips which protect the subjacent coating from scoring. Thus the coating retains its original bright appearance over a long period of time and remains insensitive to stains.

As will be readily apparent, the invention is not limited to the examples of construction which have just been described and any number of modifications may accordingly be contemplated without thereby departing from the scope of the invention.

Thus the fluorocarbon resin coating can also be of polytetrafluoroethylene associated with a resin binder such as polyamide-imide, polyether-sulfone or polyphenylene sulfide or any other thermostable resin.

Moreover, the strips or ribs can be replaced by any other raised patterns designed to reduce the sole-plate surface which is in contact with the articles to be ironed, such as a pattern in the form of pyramids or spherical caps.

Furthermore, the strips or raised patterns based on fluorocarbon resin need not be applied by screen process but could be deposited by any other technique such as decalcomania, tampography and the like.

What is claimed is:

1. A smoothing or pressing or steam iron having a metallic sole-plate, wherein a sole-plate surface which comes into contact with articles to be ironed has a series of projections (3) formed by an anti-adhesive coating of fluorocarbon resin.

2. The iron according to claim 1, wherein the projections are strips formed on said anti-adhesive material based on fluorocarbon resin and are applied on a coating (2) based on fluorocarbon resin covering an entire surface of the sole-plate.

3. The iron according to claim 2, wherein said strips (3) are substantially parallel and oriented in a longitudinal direction of the sole-plate.

4. The iron according to claim 2, wherein said strips (3) have a width within the range of a few tenths of a millimeter to a few millimeters.

5. The iron according to claim 4, wherein the thickness of said strips (3) is within the range of 2 to 50 $\mu$m.

* * * * *